United States Patent [19]

Rodriguez

[11] Patent Number: 5,033,251

[45] Date of Patent: Jul. 23, 1991

[54] AUTOMATIC PRODUCT RECOVERY APPARATUS

[75] Inventor: Samuel Rodriguez, Norristown, Pa.

[73] Assignee: McNeil-PPC, Inc., Milltown, N.J.

[21] Appl. No.: 434,744

[22] Filed: Nov. 13, 1989

[51] Int. Cl.[5] ..... B07B 11/04; B65B 57/10

[52] U.S. Cl. ..... 53/54; 53/494; 209/936

[58] Field of Search ..... 53/54, 53, 494; 209/643, 936

[56] References Cited

U.S. PATENT DOCUMENTS

| | | | |
|---|---|---|---|
| 3,889,447 | 6/1975 | Garris | 53/53 |
| 4,094,129 | 6/1978 | List | 53/54 |
| 4,530,435 | 7/1985 | Stohlquist | 209/936 X |
| 4,592,470 | 6/1986 | Mattei et al. | 209/643 X |
| 4,737,270 | 4/1988 | Phelps | 209/643 X |

*Primary Examiner*—James F. Coan

[57] ABSTRACT

Methods and apparatus for automatically recovering product from a partially-filled multiple cavity package, such as a "blister" package, are disclosed. Automatic product recovery is necessary for reducing the cost associated with the partial filling of blister packages when mass producing products, such as pharmaceuticals, that are packaged together in units. A preferred embodiments of the invention comptises a feeler and an associated photoelectric switching device disposed so that the penetration of the feeler into an unfilled cavity causes the photoelectric switching device to actuate. The actuation of the photoelectric device triggers means for recovering product from the package. The recovering means comprises air jets for dislodging the product from the package, a holding vessel, and a vacuum for transferring the product into the holding vessel. If timed recovery is desired, a microprocessor circuit for automatically triggering the recovering means at a predetermined time, is also provided.

9 Claims, 1 Drawing Sheet

AUTOMATIC PRODUCT RECOVERY APPARATUS

BACKGROUND

The present invention relates generally to the field of automated packaging apparatus, and particularly to apparatus for automatically packaging pharmaceutical products such as capsules and tablets. Typically, such products are packaged in multiple cavity packaging units, such as "blister" packages. A blister package usually comprises a clear plastic film in which dimples or cavities are formed, the dimples or cavities shaped to accommodate a product of a particular size and shape. For example, a common blister pack comprises eight cavities filled with tablets. The product, e.g., a capsule or a tablet, is individually placed into a separate cavity within the plastic film. When automated packaging equipment is utilized, the placement of product in the package is typically accomplished by means of a vacuum transfer machine. Next, the package is sealed by covering the apertures of the cavities with suitable backing material such as, for example, paper-backed foil. The backing is then fixed to the plastic film by forming a heat seal around the periphery of a predefined area encompassing a number of cavities. Finally, the periphery of each blister package is cut to a smooth edge.

A significant problem with the aforementioned methods and apparatus is the inefficiency caused by partially-filled blister packages. A partially-filled blister package occurs when, due to imperfections in the system for automatically filling the cavities with product, one or more of the cavities is not filled. When partial filling occurs, absent corrective measures being taken, the partially-filled package must either be discarded or manually separated from the fully-filled packages. If the latter course is taken, i.e., if the partially-filled packages are manually separated out, the defective packages must be unsealed and the capsules or tablets recovered therefrom. If the partially-filled package is discarded, any capsules or tablets contained therein are lost. In any event, partial filling of the blister package causes product waste and the expenditure of additional labor, resulting in higher cost to the consumer and less profit for the manufacturer. Therefore, it would be desirable to provide methods and apparatus that automatically detect empty cavities in blister packages, and automatically recover product from the packages before they are sealed.

The use of a vacuum system in conjunction with material handling and inspection apparatus is generally known. For example, U.S. Pat. No. 3,884,011—Bardo et al. discloses the use of a vacuum-based system for handling and emptying envelopes. Included in the system is a means for detecting whether an envelope has been emptied and, if not, means for rejecting and separating the reject from the rest.

As another example, U.S. Pat. No. 4,559,754—Bacon, discloses apparatus for inspecting loaves of wrapped bread. In the apparatus disclosed, a photoelectric unit 32 is used along with vacuum means 28,30, a conveyor belt 16, and a pusher plate 38 to detect the absence of a properly tied end of the bread wrapping 14. The wrapping end under inspection is pulled away from the loaf 12, by the vacuum 30, as it is carried by the conveyor belt 16 past the photoelectric unit 32. The straightened-out wrapping interrupts the beam of the photoelectric unit. By measuring the duration of time that the beam is broken, the apparatus detects improperly tied ends. The pusher plate 38 is actuated when an improperly tied end is detected, and pushes the loaf into one of two chutes 42,44, from where it can be recovered and properly tied.

Therefore, although certain defect detecting apparatus are known within various production arts, an unmet need remains for providing methods and apparatus for detecting unfilled cavities in blister packages which enables such partial filling to be remedied without product waste or the expenditure of additional manual labor.

SUMMARY OF THE INVENTION

Accordingly, it has been found that the problem of partially-filled blister packages can be avoided by utilizing automatic means to eject and recover product from a partially -filled package, the triggering of which is caused by the movement of a feeler into an unfilled cavity and an associated electrical signal being sent to a control circuit.

The present invention relates to methods and apparatus for automatically recovering product from a partially-filled multiple cavity package. The apparatus comprises: (a) means for detecting an unfilled cavity in the package; (b) means for recovering product from the package; and (c) means for automatically triggering, or actuating, the recovering means when an unfilled cavity is detected. Corresponding method steps are also disclosed.

In a preferred embodiment, the present invention comprises: (a) at least one feeler and an associated photoelectric switching device, disposed so that the penetration of the feeler into an unfilled cavity causes the photoelectric switching device to actuate; (b) recovering means comprising at least one air jet, for dislodging the product from the packaging unit, a holding vessel, and a vacuum for removing the product into the holding vessel; (c) a switch for triggering the recovering means when an unfilled cavity is detected; and, if timed recovery is desired (d) a microprocessor circuit, for automatically triggering the recovering means at a predetermined time.

DESCRIPTION OF THE PREFERRED EMBODIMENT

Figure 1:
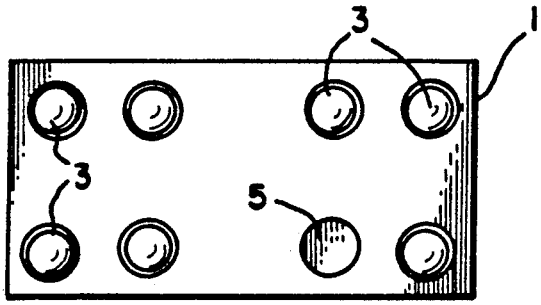
FIG. 1 depicts a plan view of a partially-filled blister package.

FIG. 1 depicts a multiple cavity package 1, having eight cavities, seven of which are filled with product 3, and one of which is unfilled, 5.

Figure 2:
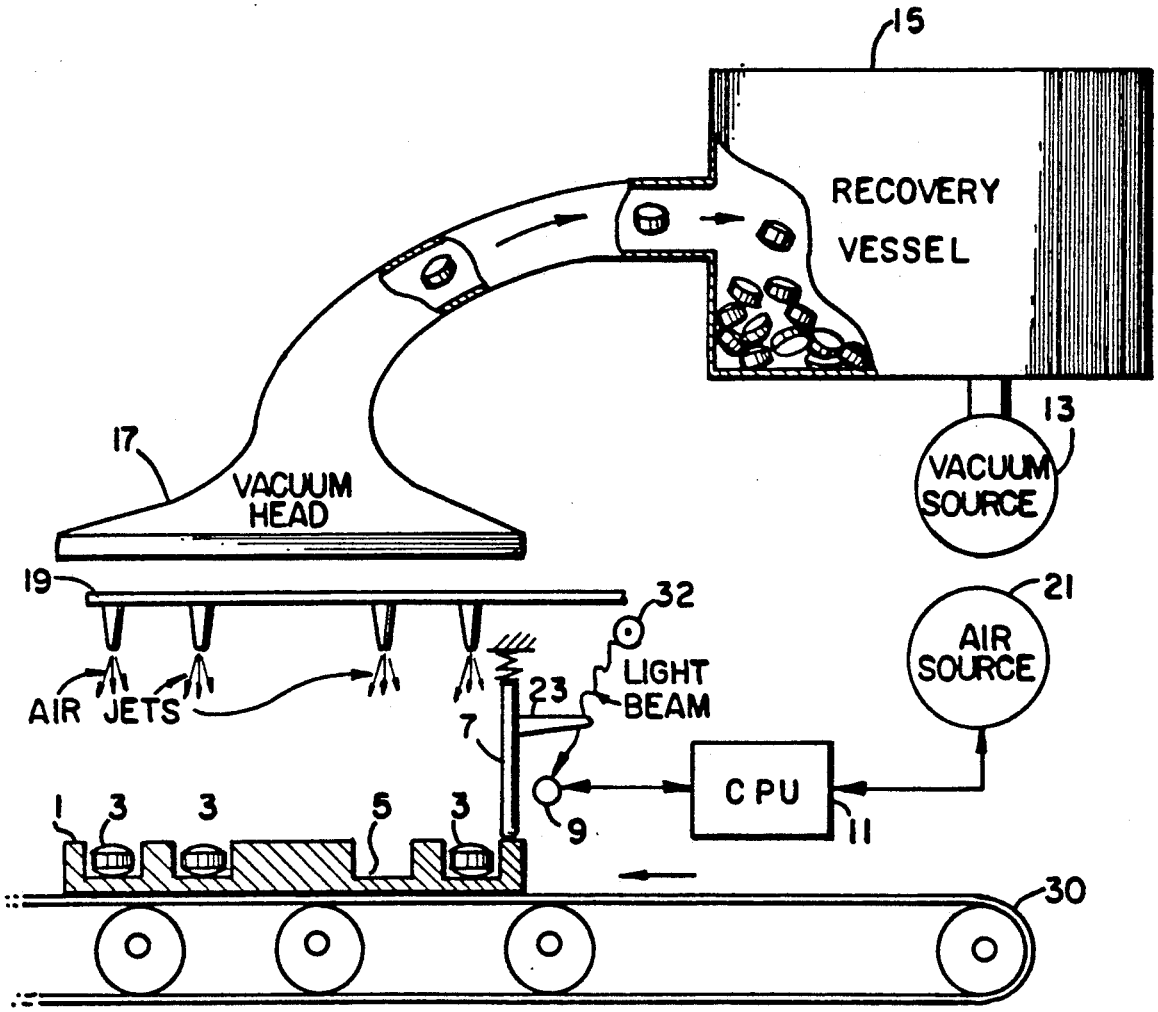
FIG. 2 is a partially schematic side view of the apparatus of the present invention showing the interrelationship of the principle elements.

Referring now to FIG. 2, which schematically depicts the apparatus of the present invention, a downwardly biased feeler 7 for detecting the presence of an unfilled cavity is shown. As shown in FIG. 2, in a preferred embodiment of the invention there is at least one feeler 7 associated with each cavity 3,5 of the package 1. The package 1 is positioned, by means of a conveyor belt 30, or the like, so that each feeler 7 aligns with its associated cavity 3,5. When a cavity is filled, its associated feeler 7 will not substantially penetrate into the cavity.

However, when a cavity is unfilled, its associated feeler, being downwardly biased, will penetrate downwardly into the cavity. When this occurs, a bar 23, attached to the feeler 7 interrupts a beam of light, from light source 32, exciting a photoelectric unit 9. This interruption is sensed by a control circuit 11. In the preferred embodiment of the invention, the control circuit 11 preferably comprises a programmable microprocessor. The control circuit 11, upon sensing an interruption in the beam exciting the photoelectric unit 9, triggers, or activates, an air compressor 21 which supplies pressurized air to jets 19, one of which is associated with, and positioned above, each cavity 3,5. To simplify the drawing, the conduit between the air compressor 21 and jets 19 is not shown. It will be readily understood by those of ordinary skill in the art that the photoelectric unit 9 could be replaced with a conventional mechanical switch or other devices to perform the above-described function of triggering, or activating, the air compressor 21.

Once the air compressor 21 is activated, high velocity air exiting the jets 19 dislodges, or ejects, any product within the filled cavities 3. Once dislodged, the product is drawn into the vacuum head 17 and transported to the holding vessel 15. Although, in the preferred embodiment, the vacuum source 13 is constantly active, the strength of the vacuum is insufficient to draw the product into the vacuum head 17 until it is first dislodged from the package 1.

Another useful embodiment of the apparatus described above includes programming the microprocessor in the control circuit 11 to trigger the air compressor 21 at a predetermined time. For example, programmed product recovery during delay periods, such as for print roller inking, may be desirable. The print roller, not shown in the FIG. 2, is used for printing labels onto the package 1.

While the invention has been described in detail with reference to preferred embodiments, it will be appreciated by those of ordinary skill in the art that variations may be made without departing from the essence of the invention.

What is claimed is:

1. Apparatus for automatically recovering product from a partially-filled multiple cavity package, comprising:

(a) means for detecting an unfilled cavity in the package;

(b) means for recovering product from the package comprising an air compressor feeding at least one air jet means for ejecting the product from the package; a holding vessel; and a vacuumtransfer system for transporting the product into the holding vessel; and (c) means for triggering said recovering means upon the detection of an unfilled cavity, whereby, the triggering of said recovering means causes the product contained in the package to be ejected from the package and recovered.

2. Apparatus according to claim 1, wherein said detecting means comprises at least one feeler and an associated switching device disposed so that the penetration of said feeler into an unfilled cavity causes said switching device to trigger said recovering means.

3. Apparatus according to claim 2 wherein said switching device comprises a photoelectric unit.

4. Apparatus according to claim 1, further comprising:

(d) means for automatically triggering said recovering means at a predetermined time.

5. Apparatus according to claim 4, wherein said means for automatically triggering the recovering means at a predetermined time comprises a microprocessor.

6. Apparatus for automatically recovering product from a partially-filled multiple cavity package, comprising:

(a) means for detecting an unfilled cavity in the package, comprising at least one feeler for penetration into an unfilled cavity;

(b) means for recovering product from the multiple cavity package, comprising at least one air jet, for dislodging the product from the packaging unit, a holding vessel, and a vacuum for removing the product into the holding vessel; and (c) means for triggering said recovering means, upon the detection of an unfilled cavity, comprising a switch, associated with said feeler, whereby the actuation of said switch causes the triggering of said recovering means, by which the product contained in the package is ejected from the package and recovered.

7. Apparatus according to claim 6, further comprising:

(d) means for automatically trigger said recovering means at a predetermined time.

8. Apparatus according to claim 6 wherein said switching device comprises a photoelectric unit.

9. Apparatus according to claim 7 wherein said means for automatically triggering the recovering means at a predetermined time comprises a microprocessor.

* * * * *